US005886281A

United States Patent [19]

Kirstein

[11] Patent Number: 5,886,281

[45] Date of Patent: Mar. 23, 1999

[54] BREECH BLOCK CONTROL FOR FIREARM FOR PROJECTILES

[75] Inventor: Gerhard Kirstein, Augsburg, Germany

[73] Assignee: Waltraud Bucher-Kirstein, Germany

[21] Appl. No.: 965,697

[22] Filed: Nov. 7, 1997

[30] Foreign Application Priority Data

Jan. 28, 1997 [DE] Germany ..... 197 02 962.0

[51] Int. Cl.[6] ..... F41A 3/16; F41A 3/26; F41A 5/18

[52] U.S. Cl. ..... 89/185; 89/187.01; 89/188; 89/192

[58] Field of Search ..... 89/172, 173, 174, 89/180, 184, 185, 187.01, 188, 179, 192, 191.01, 193; 42/16

[56] References Cited

U.S. PATENT DOCUMENTS

| | | | |
|---|---|---|---|
| 1,925,776 | 9/1933 | Scotti et al. | 89/152 |
| 3,207,036 | 9/1965 | Norton | 89/191 |
| 3,592,101 | 7/1971 | Vartanian et al. | 89/183 |
| 3,641,692 | 2/1972 | Wells | 42/25 |
| 3,675,534 | 7/1972 | Beretta | 89/185 |
| 3,776,096 | 12/1973 | Donovan | 89/174 |

FOREIGN PATENT DOCUMENTS

| | | |
|---|---|---|
| 1158875 | 7/1964 | Germany . |
| 1264294 | 3/1968 | Germany . |
| 2019232 | 11/1970 | Germany . |

*Primary Examiner*—Charles T. Jordan
*Assistant Examiner*—Christopher K. Montgomery
*Attorney, Agent, or Firm*—Ostrolenk, Faber, Gerb & Soffen, LLP

[57] ABSTRACT

The invention concerns a firearm for receiving and firing a projectile. The firearm includes an integral casing having a barrel and a breech block receiving area to the rear of the barrel. A breech block is guided through the breech block receiving area by separated guide pins which project from the breech block into respective longitudinal track sections in the barrel. The guide pins are axially separated at opposite ends of the breech block and are circumferentially separated. The longitudinal track sections meet circumferential track sections. The guide pins in the circumferential track sections permit the breech block to be rotated. The breech block has a forward closed barrel position and a rearward open loading position. A breech mount around the breech block has a cam slot that extends longitudinally and into which a cam follower pin from the breech block projects. The breech mount is drawn forward by a spring and driven rearwardly by the gas pressure from detonation of a projectile leaving the barrel. To load a projectile in the barrel, the forwardly moving breech mount moves the breech block forward along the longitudinal track sections to the forward breech closed position and then rotates the closed breech block to the locked position in the circumferential track sections.

17 Claims, 4 Drawing Sheets

BREECH BLOCK CONTROL FOR FIREARM FOR PROJECTILES

BACKGROUND OF THE INVENTION

The present invention relates to a firearm for projectiles and particularly to the design and operation of the breech. A firearm having a casing with a barrel for firing a projectile is known. It has a breech block which opens to permit loading a projectile into the barrel and is moved forward to close the breech and prevent a further projectile entering the barrel. The breech is typically locked closed. Means for moving the breech block are known.

The projectiles may have any desired form and may be fired by any desired means. For example, cartridges can be used in which the projectile is accommodated in a casing. The projectile propellant and/or the detonation means for detonating the propellant may be solid, liquid or gaseous material. The use of liquid detonation material is disclosed in DE 43 03 881 A1. The invention can be applied to all types.

Furthermore, the invention can be applied to all types of firearms, in particular to rifles, pistols and guns which are not hand-held but are held mechanically.

SUMMARY OF THE INVENTION

The object of the invention is to allow powerful or large rounds to be used even in small firearms without the detonation means or propellant, which is detonated when a round is fired, being able to emerge from the firearm at the breech. This object applies to semiautomatic and fully automatic repeater firearms as well, in particular machine guns and machine pistols, wherein the firearm is considerably smaller in physical size than is now required for rounds of comparable power.

The invention concerns a firearm for receiving and firing a projectile. The firearm includes a casing having a barrel therethrough and having a breech block receiving area to the rear of the barrel. The barrel and the breech block receiver are preferably formed in an integral body. A breech block is guided longitudinally through the breech block receiving area by separated first and second guide pins which project from the breech block into respective longitudinal track sections in the barrel. The longitudinal track sections meet circumferential track sections. When the guide pins are in the circumferential sections, the breech block may be rotated around its axis. The breech block has a forward closed barrel position and a rearward open loading position. The guide pins are axially separated at opposite ends of the breech block and are also circumferentially separated.

A breech mount around the breech block has a cam slot that extends longitudinally. A cam follower pin from the breech block projects into the cam slot. The breech mount is respectively drawn toward the front of the barrel by a spring and is driven rearwardly by gas pressure from detonation of a projectile leaving the barrel. The cam of the breech mount and the cam follower of the breech block provide sufficient play between the breech block and the breech mount that to lock a projectile in the barrel, the forwardly moving breech mount moves the breech block forward from the rearward loading position to the forward breech closed position and then rotates the closed breech block to the locked position; and to open the breech, the breech mount is moved rearwardly, which first rotates the breech block to the unlocked position due to the cam action, and continued rearward movement of the breech mount then moves the now unlocked breech block rearwardly in the barrel from the closed position to the projectile loading position.

A major feature of the invention is that locking pins for the breech block are arranged not only for movement in the circumferential direction, but the pins are also at an axial distance from one another, particularly at the front end and at the rear end of the breech block. In contrast, with known breech blocks, at least one locking pin is omitted at the front end of the breech block. This provides more space at the front end of the breech block for feeding rounds into the rear end of the barrel and for ejecting round casings after the rounds have been fired. Furthermore, the explosion force to be absorbed by the breech block when a round is fired is distributed to the receiver over the length of the breech block. In consequence, the receiver can have a relatively large opening at the front receiver end for feeding and/or ejecting rounds or round casings, without being unacceptably weakened.

A further major feature of the invention is that both the barrel and the receiver are formed in an integral body in which the breech block is accommodated and the body can move between its closed position and its loading position. The integral nature of the body not only enables its small physical size but it also reduces the risk of detonated or exploding detonation means and/or propellant in the round being able to emerge from the firearm in the region of the breech at the rear end of the barrel.

Other features and advantages of the present invention will become apparent from the following description of the invention which refers to the accompanying drawings showing a preferred embodiment as an example.

DETAILED DESCRIPTION OF THE INVENTION

Figure 1:
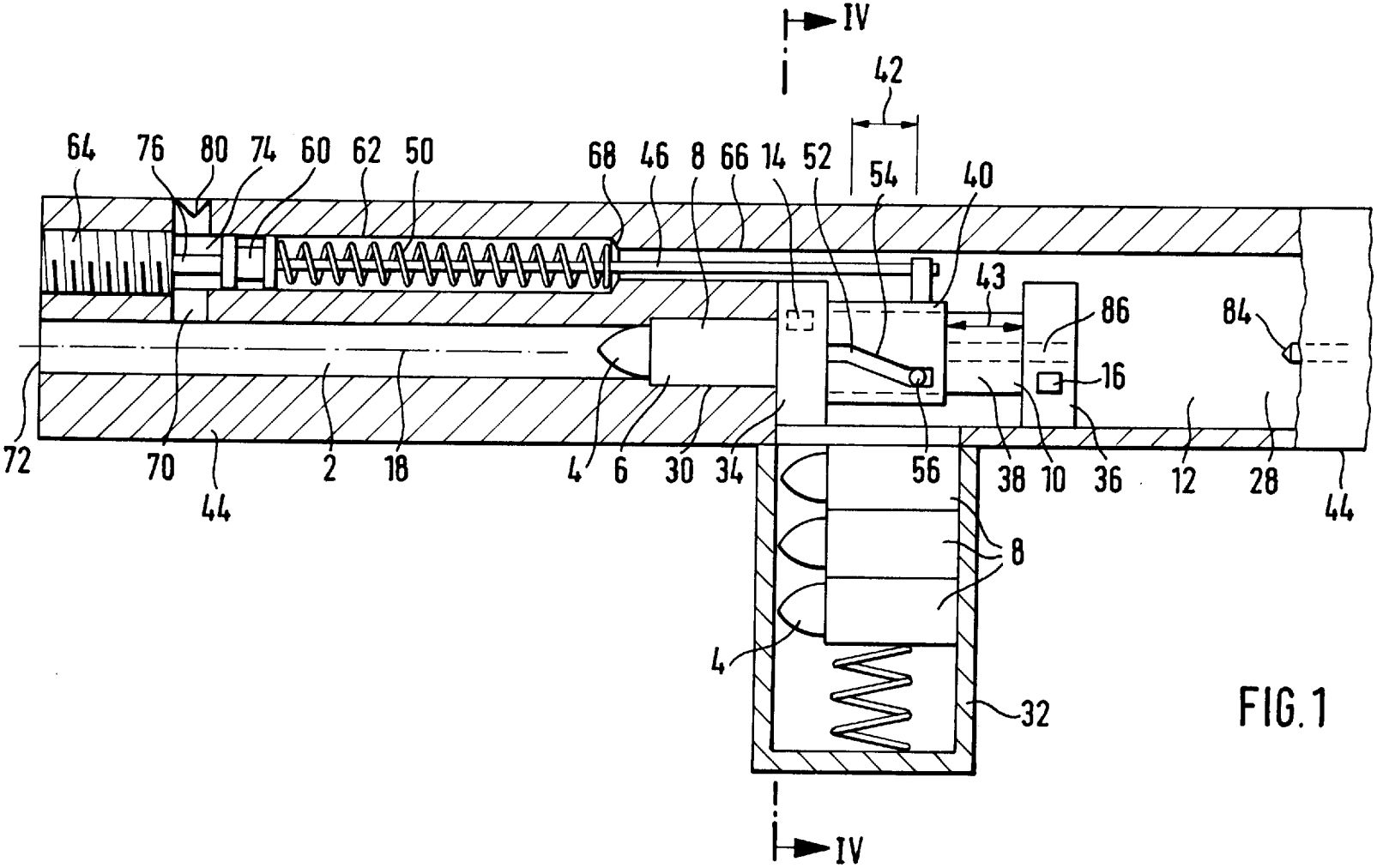
FIG. 1 shows a schematic axial section of the barrel, the breech assembly and a magazine of a firearm according to the invention, ready to fire, with a cartridge in a firing chamber.

The firearm according to the invention and illustrated in the drawings has a barrel 2 for projectiles 4. The projectiles 4 are in casing 6 of cartridges 8. A breech block 10, which is elongated like a piston, is arranged axially with respect to the barrel 2 in a receiver 12 at the rear end of the barrel. The block 10 has a radially projecting locking pin 14 on its front end section, and at least one further locking pin 16 on its rear end section. These locking pins are arranged at a distance from one another both axially and in the circumferential direction, relative to the longitudinal axis 18 of the barrel 2. Locking pins of this type can also be called "lugs".

Figure 3:
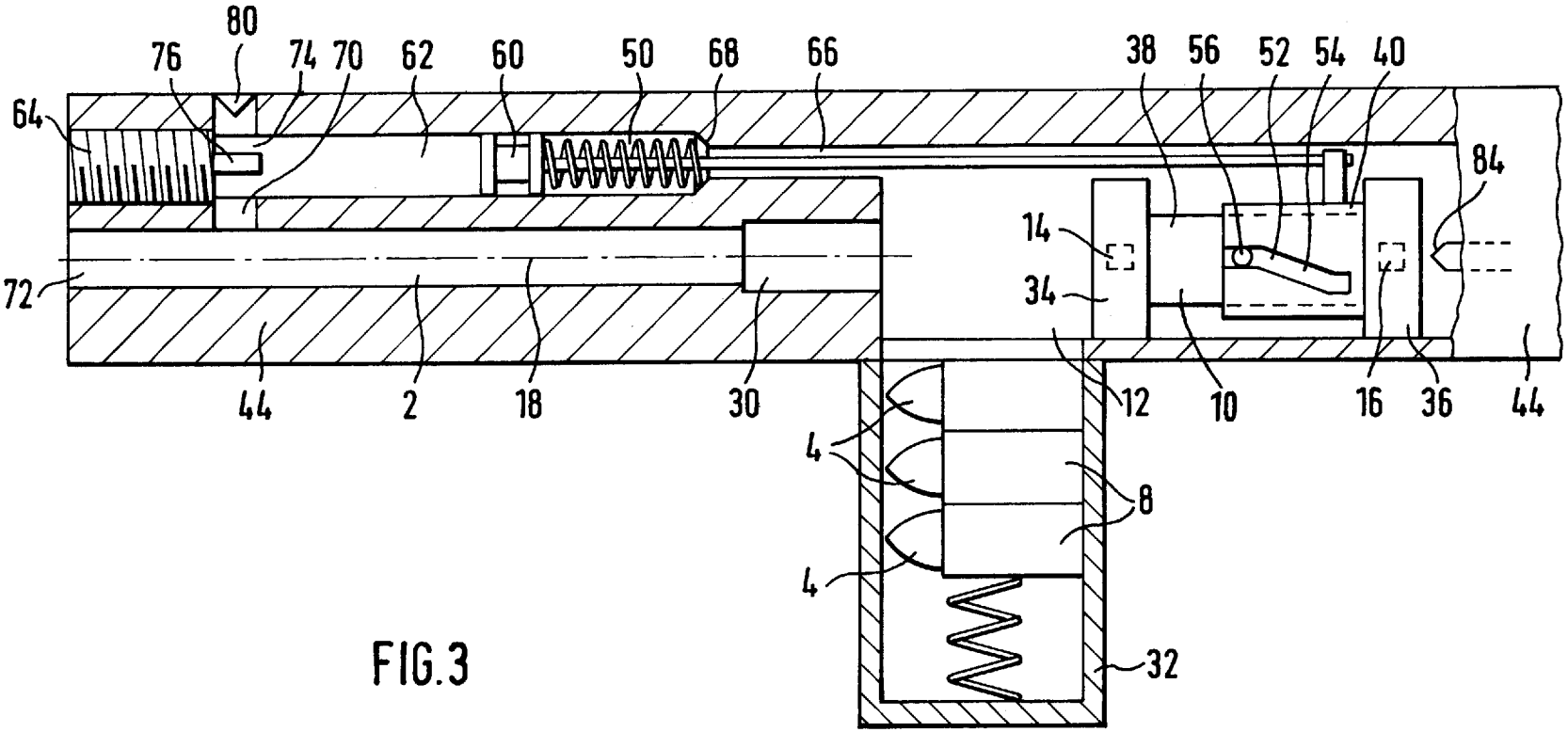
FIG. 3 shows the firearm of FIG. 1, after the round has left the barrel and with the breech block moved back completely, so that a new cartridge can be fed into the firing chamber.

The locking pins 14 and 16 each engage in a respective guide track 22 and 24, and extend at an angle, according to FIGS. 4 to 7. The guide tracks are diametrically opposite and are formed in the side walls 26 and 28, respectively, of the receiver 12. The locking pins 14 and 16 are guided in the guide tracks 22 and 24. Each guide track 22 and 24 includes a respective longitudinal track section 23 and 25, which extends longitudinally relative to the barrel longitudinal axis 18. At their front ends, each track section 23, 25 respectively has a circumferential track section 27 and 29 that extends at right angles from the longitudinal track section and in the circumferential direction. The parts mentioned above are arranged such that the breech block 10 can be displaced axially by operating means, described below, relative to the barrel 2 between a front closed position, in which it closes access to the rear end of the barrel 2 according to FIG. 1, and a rear loading position for a round, which is shown in FIG. 3. In the loading position in FIG. 3, an empty cartridge casing 6 can be ejected from the firing chamber 30 formed at the rear end of the barrel, and a new cartridge 8 can be fed from a magazine 32 into the empty firing chamber 30, as is known for firearms.

Figure 2:
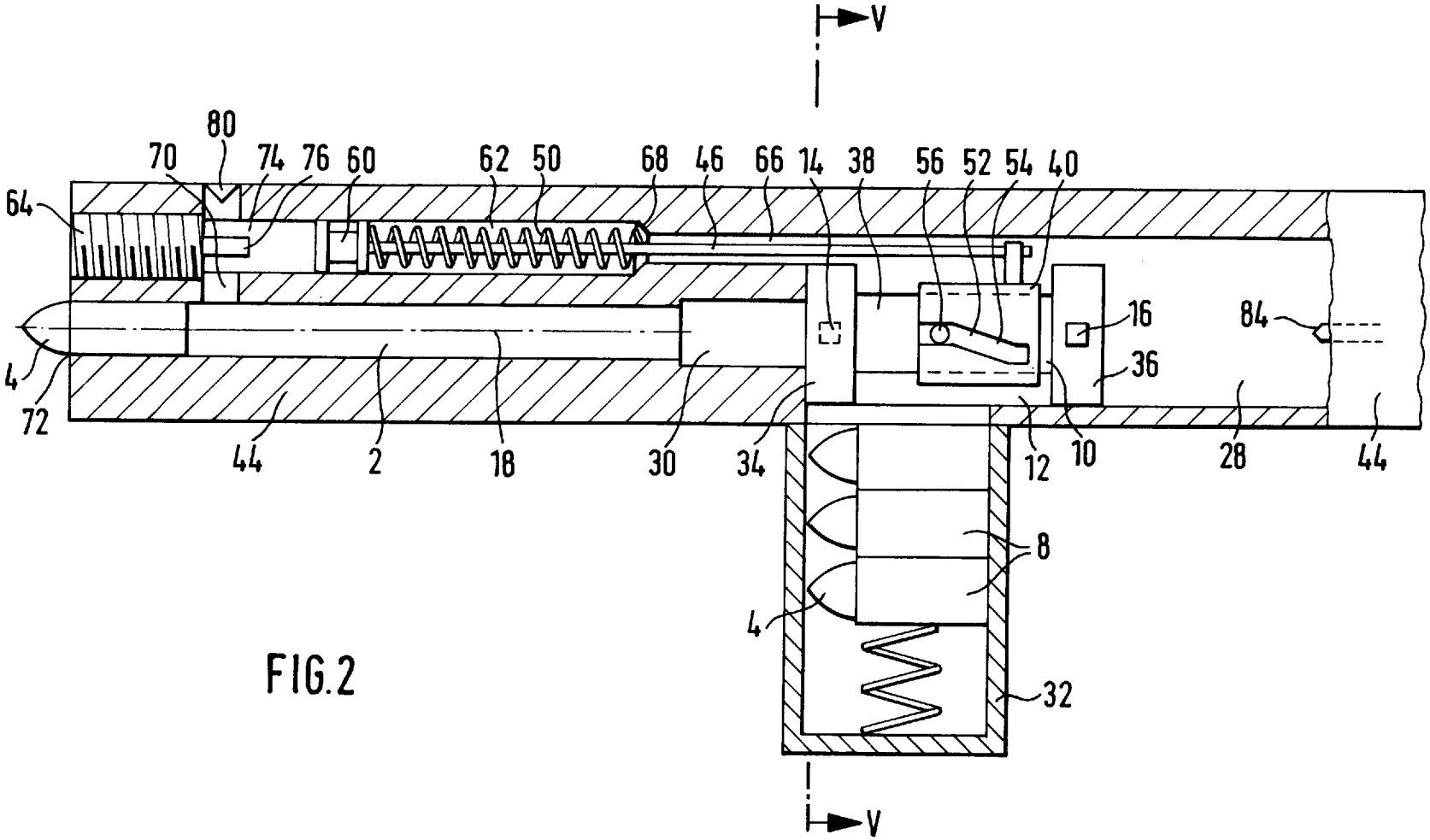
FIG. 2 shows the firearm of FIG. 1 after a round has been fired, and with the round in the front end section of a barrel.
Figure 4:
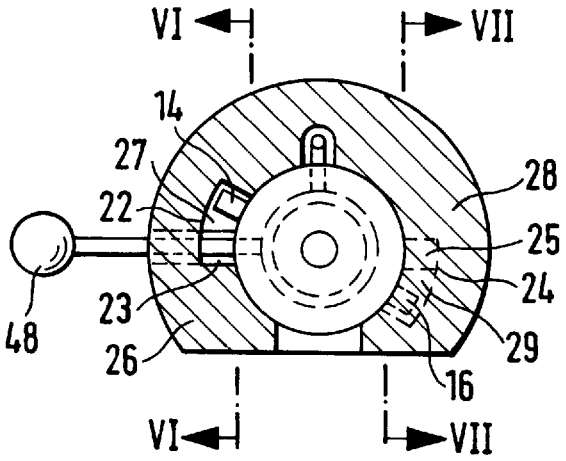
FIG. 4 shows a cross sectional view along the plane IV—IV of FIG. 1, without a magazine, showing a breech block in the locked closed position.
Figure 5:
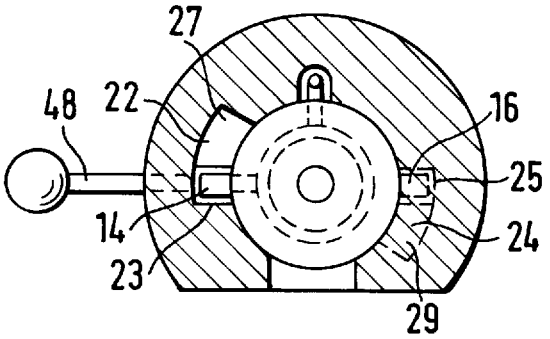
FIG. 5 shows a cross section along the plane V—V of FIG. 2, without a magazine, showing the breech block in its unlocked closed position.

The breech block 10 can be rotated between its locked position, shown in FIGS. 1 and 4, and its unlocked position, shown in FIGS. 2, 3 and 5, only when it is in the closed position shown in FIG. 1. A round 4 can be fired only when the breech block 10, in the closed position, has been rotated into the locked position, which is illustrated in FIGS. 1 and 4. After a round has been fired, the breech block 10 must first be rotated, in its closed position, from its locked position in FIG. 1 and FIG. 4 into its unlocked position according to FIGS. 2, 3 and 5. Only then can the breech block be displaced axially from the closed position axially back into the loading position of FIGS. 1, 2 and 3.

The locking pins 14 and 16 are arranged at a distance from one another in the circumferential direction, and are preferably diametrically opposite. The locking pins 14 and 16 are also arranged at an axial distance from one another. One locking pin 14 is arranged on the outer circumference of a cylindrical, front end section 34 of the breech block, and the other locking pin 16 being arranged on the outer circumference of a cylindrical, rear end section 36 thereof. The two cylindrical end sections 34 and 36 are connected to one another by a cylindrical connecting section 38, which has a smaller diameter than the end sections. The connecting section 38 forms an integral part with one end section, for example, to the rear end section 36, and is detachably connected to the relevant other end section, for example, to the front end section 34, in order that a cylindrical breech mount 40 in the form of a sleeve can be fitted onto the connecting section 38. The breech mount 40 can be displaced axially, at least for a distance 42 relative to the breech block 10, between the end sections 34 and 36 of the breech block 10, that is, the amount of axial play 43 between the two end sections 34 and 36 corresponds at least to the distance 42. The breech mount 40 is arranged axially behind the barrel 2.

An integral body 44 is provided, which forms the barrel 2 and the receiver 12. The integral body 44 accommodates the breech block 10 and its breech mount 40, and the guide tracks 22 and 24 for the locking pins 14 and 16 are also formed in it.

Figure 6:
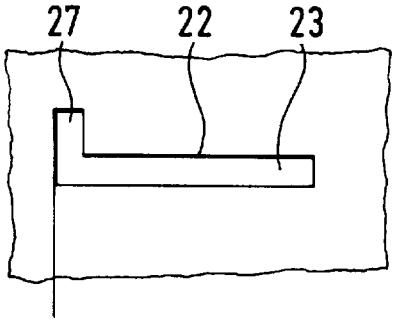
FIG. 6 shows a detail along the plane VI—VI of FIG. 4.
Figure 7:
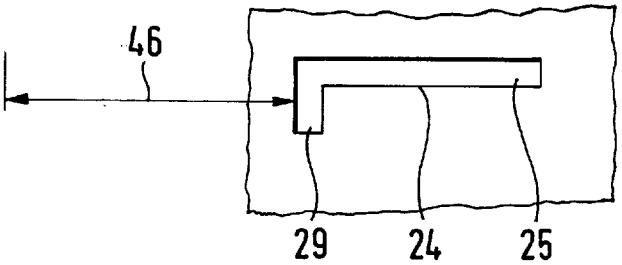
FIG. 7 shows a detail along the plane VII—VII of FIG. 4, in a mirror-image illustration.

According to FIGS. 6 and 7, the circumferential track sections 27 and 29 of the guide tracks 22 and 24 are the same axial distance 46 apart from one another as the locking pins 14 and 16 which engage in them. The axial length of the longitudinal track sections 23 and 25 is at least as large as the axial displacement distance of the breech block 10 between its closed position shown in FIG. 1 and its loading position shown in FIG. 3.

The breech mount 40 is arranged in the receiver 12 such that it cannot rotate, but it can be displaced axially by a piston rod 46 and a cocking handle 48. The breech mount 40 and the breech block 10 can be operated manually by the cocking handle 48 or automatically by the piston rod 46 in the manner described below in order to eject the empty cartridge case 6 after a round 4 has been fired and to feed a new cartridge 8 from the magazine 32 into the firing chamber 30. The cocking handle 48 extends out of the integral body 44 at the side, preferably through the longitudinal track section 27 of the guide track 22 which is assigned to the front locking pin 14, as FIGS. 4 and 5 show. For this purpose, this longitudinal track section 27 is designed as a slot which extends through the integral body 44. The cocking of the breech block 10 by action of the breech mount 40 to the rear or the right takes place against a forward acting force from a helical compression spring 50.

The breech mount 40 is provided on at least one of its sides with a cam 52 in the form of a slot which has an oblique or helical profile 54 over the axial length of the distance 42, similar to a thread groove between two threads. The breech block 10 is provided with a control pin 56 which engages, projecting radially from it, in the cam 52. The cam 52, in particular its oblique profile 54, and the control pin 56 are designed such that they rotate the breech block 10, in its closed position, from the unlocked position in FIG. 5 into the locked position in FIGS. 1 and 4 when the breech mount 40 is moved axially forward, relative to the breech block 10, from its axial position shown in FIG. 2 into its axial position shown in FIG. 1. During the opposite axial movement of the breech mount 40 relative to the breech block 10 through the distance 42 from the axial position in FIG. 1 into the axial position in FIG. 2, the breech block 10 is rotated, in its closed position shown in FIG. 1, from the locked position in FIGS. 1 and 4 into the unlocked position in FIGS. 2, 3 and 5, since the control pin 56 is rotated by the oblique profile 54 of the cam 52 in the opposite direction about the longitudinal axis 18 of the barrel 2. In both cases, as the control pin 56 slides on one or the other edge of the oblique profile 54, the axial movement of the breech mount 40 is converted into rotational locking or unlocking movement of the control pin 56 and of the breech block 10.

During the unlocking process described above, the breech mount 40 is moved axially to the rear from the position in FIG. 1 into the position in FIG. 2, but the breech block 10 remains in its front position, in the closed position. When the breech mount 40 is moved further to the rear from the unlocked position shown in FIG. 2, and to the right with respect to FIGS. 2 and 3, it comes into contact with the rear end section 36 of the breech block 10. The breach mount thereafter drives the breech block axially from the closed position in FIG. 2 into the loading position in FIG. 3. In the loading position, the breech block 10 is located axially behind the magazine 32. This enables the empty cartridge case 6 to be ejected from the firing chamber 30 and a new cartridge 8 to be fed from the magazine 32 into the firing chamber 30. There is no need for further rearward movement of the breech block 10 beyond the loading position. The rearward movement can be limited, for example, by the longitudinal track section 27 of the guide track 22 having an appropriately selected length, with the cocking handle 48 extending through the guide track 22 so that the cocking lever 48 strikes against the end of the longitudinal track section 27 when the breech block 10 has reached its loading position.

According to FIG. 2, there may still be some axial play between the breech mount 40 and the rear end section 36 of the breech block 10 beyond the unlocking process. The cam 52 may also have sections parallel to the axis at one or both ends beyond its oblique profile 54, into which sections the control pins 56 can latch. This allows the unlocked position and the locked position to be better defined. The cam 52, which is in the form of a slot in the breech mount 40, extends at one curve end, preferably at the front curve end, into the end-face end of the breech mount 40 and is open there in order that the breech mount 40 can be fitted axially to the breech block 10 and the control pin 56 can at the same time be inserted into the cam 52.

The piston rod 46 is connected at its rear end to the breech mount 40 and at its front end to an operating piston 60. The operating piston 60 is arranged in a cylindrical hole 62 that extends axially through the body 44, such that the piston is gas-tight and can be displaced axially in the hole 62. The cylindrical hole 62 is formed parallel to the barrel 2 in the integral body 44 and is closed gas-tight at its front end by a sealing element 64. The cylindrical hole 62 extends from the front end of the integral body 44 into the receiver 12. The hole has a rear end section 66 with a smaller diameter and through which the piston rod 46 extends.

The compression spring 50 is clamped axially in a prestressed manner between the piston 60 and a step 68 in the hole. The spring can move the breech block 10, via the operating piston 60 and the breech mount 40, axially from the loading position in FIG. 3 into the closed position in FIG. 1 and can rotate it there, by means of the cam 52 and the control pin 56, into the locked position in FIG. 1.

A gas connecting channel 70 connects the barrel 2, at a point which is axially remote from the rear end of the barrel (firing chamber 30) and, respectively, at a point which is axially remote from the front end of the barrel 72, to the cylindrical hole 62 on the side of the operating piston 60 facing away from the compression spring. A pressure chamber 74 is formed there between the operating piston 60 and the front end of the cylindrical hole 62. The sealing element 64 has an axial projection 76 which has a considerably smaller cross section than the cylindrical hole 62 in the region of the connecting channel 70. In consequence, any gas pressure which propels a projectile 4 through the barrel 2 can act, from the barrel 2 and through the gas connecting channel 70, on the side of the operating piston 60 facing away from the compression spring 50 and can move the operating piston 60, against the force of the compression spring 50, to the rear on the right in FIGS. 1, 2 and 3, to such an extent that the breech block 10 is rotated, via the cam 52 and the control pin 56 of the breech mount 40, from the locked position to the unlocked position in the closed position in FIG. 1, and is then moved axially to the rear from the closed position in FIG. 1 to the loading position in FIG. 3. In the loading position in FIG. 3, the empty cartridge case 6 can then be ejected automatically and a new cartridge 8 can be fed into the firing chamber 30 at the rear end of the barrel. These processes can, of course, also be carried out by hand instead of automatically, particularly if there is no magazine 32 and the rounds or cartridges must be inserted into the firing chamber 30 by hand.

The pressure chamber 74 is preferably provided with an adjustable pressure limiting valve 80, which adjusts the maximum gas pressure in the pressure chamber 74. This has the advantage that the operating piston 60, and thus also the breech block 10, can always be operated by the same gas pressure in the pressure chamber 74 in the event of the rounds 4 producing propellant gas pressures of different intensity.

The projectiles 4 can be fired in any desired known manner by means of solid, liquid or gaseous detonating means and/or propellant. In the illustrated embodiment, a firing pin 84 is arranged axially with respect to the barrel axis 18, behind the breech block 10. The firing pin 84 can strike against a firing cap at the rear end of the cartridge, in order to detonate the cartridge detonator, by a known operating mechanism (which is not illustrated), for example a hammer which can be operated by a finger operated trigger, through an axial hole 86 in the breech block 10.

According to another embodiment, the cam 52 is formed in the breech block 10, and the control pin 56 is provided on the breech mount 40.

A control roller or control ball, or another type of cam follower element, can be used instead of a control pin 56.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A firearm for projectiles, comprising:

a body defining a barrel for holding and directing projectiles to exit the barrel, the barrel having a front end from which projectiles are expelled and having an opposite rear end; a breech block receiver in the body toward the rear end of the barrel;

a breech block in the breech block receiver and selectively movable toward the front and the rear end of the barrel;

a first and a second locking pin projecting radially from the breech block, spaced apart from one another along the barrel and also spaced apart around a circumference of the breech block;

the body having a respective guide track for each of the locking pins, each guide track having a longitudinally extending track section that guides the breech block for movement longitudinally between a front closed position that closes the barrel against loading and unloading of a projectile and a rear loading position where the breech block is in position to permit access to the barrel for loading or unloading a projectile from the barrel;

each guide track also having a circumferentially extending track section which meets the longitudinally extending track section, and the circumferentially extending track section is so positioned that with the breech block in the front closed position, the locking pins align with the circumferentially extending track sections and the breech block is then rotatable, whereas the breech block is movable longitudinally along the barrel but is not rotatable when the locking pins are in the longitudinally extending track sections, and when the locking pins are in the circumferential section, the breech block is locked against longitudinal movement due to detonation pressure and propellant pressure from the round.

2. The firearm of claim 1, wherein the breech block has a front end section toward the front of the barrel and a rear end section toward the rear of the barrel and the locking pins are at the front and rear end sections of the breech block.

3. The firearm of claim 2, wherein the body is an integral body including the barrel and the breech block receiver.

4. The firearm of claim 1, further comprising a projectile supply at the firearm communicating with the breech block receiver at a location such that with the breech block in the rear loading position, a projectile can enter from the projectile supply into the receiver forward of the breech block, and with the breech block in the forward closed position, a projectile is blocked by the breech block from entering the breech block receiver and the barrel.

5. The firearm of claim 1, further comprising a breech mount in the breech block receiver and the breech mount is movable past the breech block; means supporting the breech mount in the breech block receiver for enabling the breech mount to move longitudinally along the breech block receiver but preventing the breech mount from rotating in the breech block receiver;

first cooperating cam elements on the breech block and the breech mount such that with the locking pins in the circumferential track sections, movement of the breech mount rearward in the body rotates the breech block to an unlocked position with the locking pins in the longitudinal track sections, and movement of the breech mount forward in the body rearward of the body rotates the breech block to a locked position with the locking pins moving through the circumferential track sections; and with the locking pins in the longitudinal track sections, movement of the breech mount rearward in the body moves the breech block to the rear loading position and movement of the breech mount forward in the body moves the breech block to the forward closed position with the locking pins at the circumferential track section able to rotate to the breech block locking position upon further forward movement of the breech mount in the body.

6. The firearm of claim 1, further comprising a breech mount in the breech block receiver and the breech mount is movable past the breech block; means supporting the breech mount in the breech block receiver for enabling the breech mount to move longitudinally along the breech block receiver but preventing the breech mount from rotating in the breech block receiver;

a cam provided on one of the breech block and the breech mount and a cam follower provided on the other of the breech block and the breech mount;

the cam having an oblique profile over at least part of its length for rotating the breech block about an axis along the longitudinal direction of the barrel when the breech block is in the closed position and the locking pins are in the circumferential track sections; when the locking pins of the breech block are in the longitudinally extending track section, as the breech mount moves axially relative to the breech block, the cam and cam follower are so shaped that the breech block is moved due to longitudinal direction movement of the breech mount; the breech mount being movable longitudinally in the breech block receiver such that the breech mount causes movement of the breech block between the front closed position and the rear loading position when the breech block is in an unlocked position with the locking pins in the longitudinally extending track section.

7. The firearm of claim 6, wherein the cam comprises a slot in the respective one of the breech block and the breech mount and the cam follower comprises a pin in the other of the breech mount and the breech block and received in the slot; the slot having ends engaged by the pin such that the engagement then causes the breech mount to move the breech block in the longitudinal direction.

8. The firearm of claim 7, wherein the breech mount comprises a sleeve around the breech block and the breech block extends through the breech mount sleeve.

9. The firearm of claim 6, wherein the breech mount comprises a sleeve around the breech block and the breech block extends through the breech mount sleeve.

10. The firearm of claim 6, wherein the breech mount includes the cam thereon and the breech block has the cam follower thereon which engages the cam.

11. The firearm of claim 6, further comprising an operating piston in the body which is connected with the breech mount for displacing the breech mount longitudinally;

a gas connection channel spaced forwardly from the rear end of the barrel and also spaced rearwardly from the front end of the barrel;

a pressure chamber at the side of the piston away from the breech mount and communicating with the gas connecting channel such that gas pressure which propels the projectile out the front of the barrel passes through the gas connecting channel and into the pressure chamber for moving the piston to the rear of the body for moving the attached breech mount to the rear of the body, and the movement of the breech mount to the rear first moves the cam follower past the cam to rotate the breech block so that the locking pins are moved through the circumferential track section to the longitudinal track section and then continues to move both the breech mount and the breech block rearwardly from the breech block closed position to the breech block loading position.

12. The firearm of claim 5, further comprising an operating piston in the body which is connected with the breech mount for displacing the breech mount longitudinally;

a gas connection channel spaced forwardly from the rear end of the barrel and also spaced rearwardly from the front end of the barrel;

a pressure chamber at the side of the piston away from the breech mount and communicating with the gas connecting channel such that gas pressure which propels the projectile out the front of the barrel passes through the gas connecting channel and into the pressure chamber for moving the piston to the rear of the body for moving the attached breech mount to the rear of the body, and the movement of the breech mount to the rear first moves a cam follower past a cam to rotate the breech block so that the locking pins are moved through the circumferential track section to the longitudinal track section and then continues to move both the breech mount and the breech block rearwardly from the breech block closed position to the breech block loading position.

13. The firearm of claim 12, further comprising a spring acting on the piston for normally urging the piston toward the front end of the barrel and upon the cam follower engaging the cam, moving the breech block into the closed position by moving the locking pins along the longitudinal track section and then rotating the breech block into the locking position by the cam follower moving along the cam to rotate the breech block and to rotate the locking pins through the circumferential track section.

14. The firearm of claim 12, further comprising adjustable pressure limiting means at the pressure chamber for adjustably limiting the maximum gas pressure in the pressure chamber.

15. The firearm of claim 9, further comprising a cylindrical hole in the body for a piston which extends parallel to the barrel.

16. The firearm of claim 5, further comprising a handle connected with the breech mount and projecting from the body, and the handle being operable to move the breech mount by hand to the various positions thereof.

17. The firearm of claim 5, further comprising firing means at the barrel for engaging and detonating a projectile supported in the barrel such that the projectile will be fired from the front end of the barrel.

* * * * *